US011387578B2

(12) United States Patent
Karita et al.

(10) Patent No.: US 11,387,578 B2
(45) Date of Patent: Jul. 12, 2022

(54) SHIELDED ELECTRICAL CONNECTOR

(71) Applicant: SUMITOMO WIRING SYSTEMS, LTD., Mie (JP)

(72) Inventors: Masahiro Karita, Mie (JP); Yasuo Imai, Mie (JP)

(73) Assignee: SUMITOMO WIRING SYSTEMS, LTD., Mie (JP)

( * ) Notice: Subject to any disclaimer, the term of this patent is extended or adjusted under 35 U.S.C. 154(b) by 0 days.

(21) Appl. No.: 17/278,331

(22) PCT Filed: Sep. 9, 2019

(86) PCT No.: PCT/JP2019/035347

§ 371 (c)(1),
(2) Date: Mar. 22, 2021

(87) PCT Pub. No.: WO2020/066567

PCT Pub. Date: Apr. 2, 2020

(65) Prior Publication Data

US 2021/0351521 A1 Nov. 11, 2021

(30) Foreign Application Priority Data

Sep. 27, 2018 (JP) ..... JP2018-182116

(51) Int. Cl.
*H01R 4/18* (2006.01)
*H01R 13/506* (2006.01)
*H01R 13/6593* (2011.01)

(52) U.S. Cl.
CPC ..... *H01R 4/18* (2013.01); *H01R 13/506* (2013.01); *H01R 13/6593* (2013.01)

(58) Field of Classification Search
CPC ..... H01R 13/506; H01R 4/18; H01R 13/6593
See application file for complete search history.

(56) References Cited

U.S. PATENT DOCUMENTS 9,531,132 B2 * 12/2016 Iwamoto ..... H01R 13/6581 439/607.41
10,833,456 B2 11/2020 Maesoba et al.
2017/0093076 A1 3/2017 Yokoyama
2019/0013614 A1 1/2019 Matsui et al.

FOREIGN PATENT DOCUMENTS

JP 2000-012162 A 1/2000
JP 2002-367732 A 12/2002

OTHER PUBLICATIONS

International Search Report dated Oct. 8, 2019 for WO 2020/066567 A1 (3 pages).

* cited by examiner

*Primary Examiner* — Briggitte R. Hammond
(74) *Attorney, Agent, or Firm* — Venjuris, P.C.

(57) ABSTRACT

A connector (A) includes a dielectric and a multi-functional portion, an outer conductor is configured by uniting a first divided shell and a second divided shell, a first crimping portion to be crimped to an outer periphery of a shield member of a shielded cable is formed in a rear end part of the first divided shell, the multi-functional portion is exposed on an outer surface of the outer conductor and in the form of a projection forward of the first crimping portion on an outer surface of the dielectric, the first divided shell is formed with a first locking portion disposed to be able to lock the multi-functional portion, and a locking direction of the first locking portion to the multi-functional portion is a direction opposite to the first crimping portion to the shield member.

6 Claims, 10 Drawing Sheets

SHIELDED ELECTRICAL CONNECTOR

TECHNICAL FIELD

The present disclosure relates to a connector.

BACKGROUND

Patent Document 1 discloses a connector with a plurality of inner conductors, a dielectric and an outer conductor. The plurality of inner conductors are individually connected to front end parts of a plurality of wires constituting a shielded cable. The dielectric accommodates the plurality of inner conductors. The outer conductor surrounds the inner conductors and the dielectric. The outer conductor includes a tubular member for surrounding a front end side region of the dielectric and a pair of divided shells having a half shape and disposed behind the tubular member. A pair of crimping portions formed in rear end parts of the respective divided shells are crimped to the outer periphery of a shield layer constituting the shielded cable.

In a crimping process, the pair of crimping portions are pressed in directions toward each other. Since the pair of crimping portions are disposed in the rear end parts of the pair of divided shells, the postures of the pair of divided shells are going to be inclined such that front end parts thereof are separated from each other. However, since the front end parts of the divided shells are locked to the tubular member, there is no possibility that the postures of the pair of divided shells are inclined.

PRIOR ART DOCUMENT

Patent Document

Patent Document 1: JP 2018-125243 A

SUMMARY OF THE INVENTION

Problems to be Solved

In inserting a connector into a housing, it is necessary to avoid the insertion of the connector in an improper orientation into the housing by visually observing a front end part of the connector to confirm vertical and lateral orientations of the connector. However, since the front end part of the above connector has a vertically and laterally symmetrical rectangular tube shape, it is difficult to confirm the vertical and lateral orientations of the connector by visually observing the front end part of the connector.

As a countermeasure against this, it is considered to constitute the outer conductor by a pair of divided shells having asymmetric shapes. However, even if the asymmetric divided shells are united, it is not easy to distinguish the orientation by visual observation since the front end part of the connector is formed into a rectangular tube shape in conformity with the outer shape of the dielectric.

The present invention was completed on the basis of the above situation and aims to prevent posture inclination during the crimping of an outer conductor and enable an orientation of a connector to be easily distinguished.

Means to Solve the Problem

A connector of the present disclosure includes a plurality of inner conductors, a dielectric, an outer conductor, and a multi-functional portion, wherein the plurality of inner conductors are individually connected to front end parts of a plurality of cores constituting a shielded cable, the dielectric accommodates the plurality of inner conductors, the outer conductor is configured by uniting a first divided shell and a second divided shell, the outer conductor surrounds the inner conductors and the dielectric, a first crimping portion to be crimped to an outer periphery of a shield member constituting the shielded cable is formed in a rear end part of the first divided shell, the multi-functional portion is exposed on an outer surface of the outer conductor and in the form of a projection forward of the first crimping portion on an outer surface of the dielectric, the first divided shell is formed with a first locking portion disposed to be able to lock the multi-functional portion, and a locking direction of the first locking portion to the multi-functional portion is a direction opposite to a crimping direction of the first crimping portion to the shield member.

Effect of the Invention

According to the present disclosure, it is possible to prevent posture inclination during the crimping of an outer conductor and enable an orientation of a connector to be easily distinguished.

DETAILED DESCRIPTION TO EXECUTE THE INVENTION

Description of Embodiments of Present Disclosure

Figure 1:
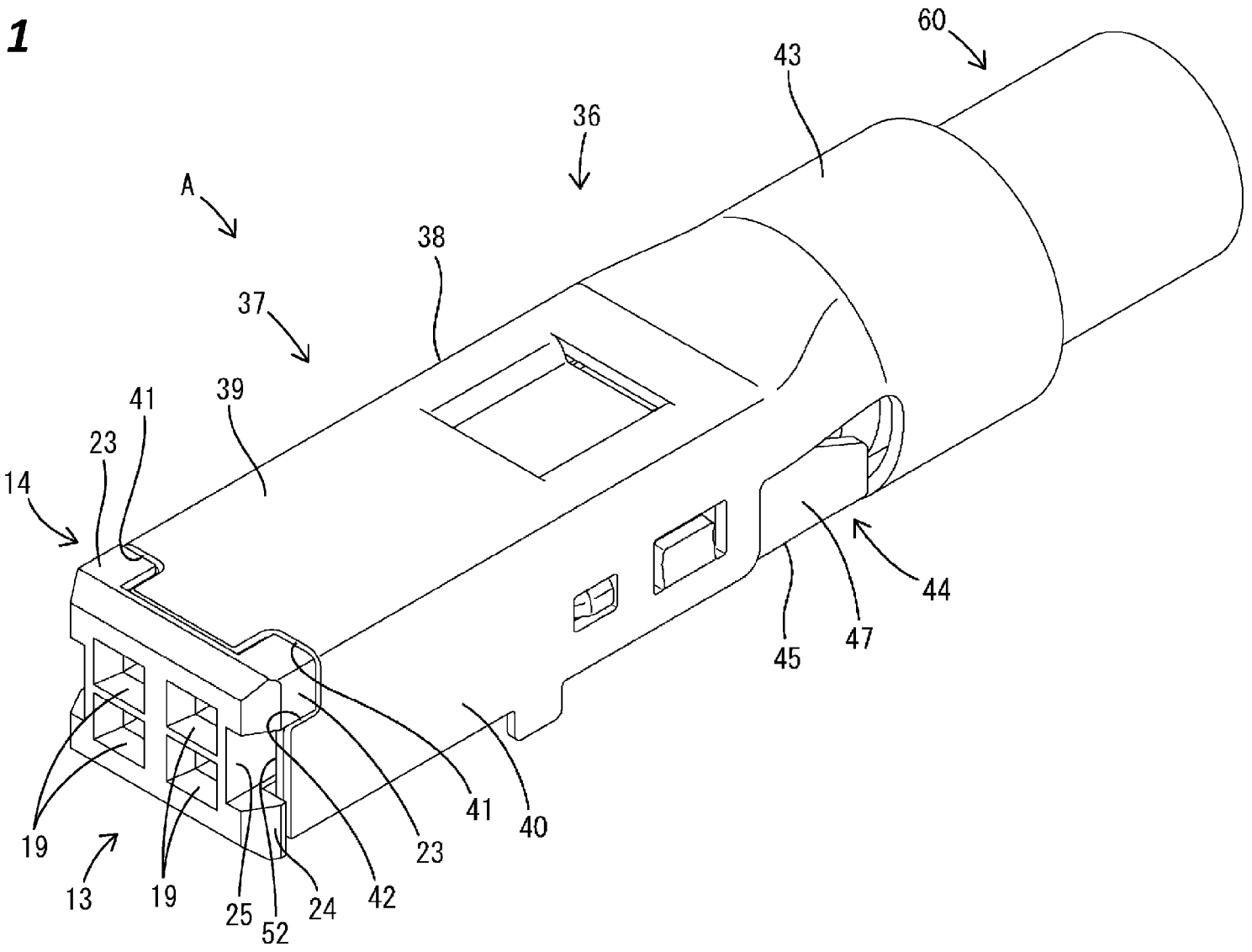
FIG. 1 is a perspective view of a shield terminal of one embodiment.

First, embodiments of the present disclosure are listed and described.

(1) The connector of the present disclosure includes a plurality of inner conductors, a dielectric, an outer conductor, and a multi-functional portion, wherein the plurality of inner conductors are individually connected to front end parts of a plurality of cores constituting a shielded cable, the dielectric accommodates the plurality of inner conductors, the outer conductor is configured by uniting a first divided shell and a second divided shell, the outer conductor surrounds the inner conductors and the dielectric, a first crimping portion to be crimped to an outer periphery of a shield member constituting the shielded cable is formed in a rear end part of the first divided shell, the multi-functional portion is exposed on an outer surface of the outer conductor and in the form of a projection forward of the first crimping portion on an outer surface of the dielectric, the first divided shell is formed with a first locking portion disposed to be able to lock the multi-functional portion, and a locking direction of the first locking portion to the multi-functional portion is a direction opposite to a crimping direction of the first crimping portion to the shield member.

According to the configuration of the present disclosure, since the multi-functional portion is in the form of a projection and exposed on the outer surface of the outer conductor, an orientation of the connector can be confirmed by visually observing the position of the multi-functional portion. When the first crimping portion is crimped to the shield member, the first locking portion of the first divided shell locks the multi-functional portion in the direction opposite to the crimping direction. Thus, the posture inclination of the first divided shell during crimping can be prevented.

(2) Preferably, the multi-functional portion is disposed in a front end part of the dielectric. According to this configuration, since the multi-functional portion is exposed on the outer surface of the outer conductor in a front end part of the connector, visual observation is easier as compared to the case where the multi-functional portion is exposed behind the front end of the connector. Further, since the multi-functional portion is disposed in the front end part of the dielectric, a long distance in a front-rear direction is ensured between the first crimping portion and the multi-functional portion. Thus, a function of preventing the posture inclination of the first divided shell is excellent.

(3) Preferably, the multi-functional portions are formed only on two corners, out of four corners of a front wall portion of the dielectric. According to this configuration, the orientation of the connector can be visually confirmed from many directions by the presence of the two multi-functional portions.

(4) Preferably, the dielectric includes an accommodating member and a cover, the accommodating member includes accommodation chambers for accommodating the inner conductors, the cover covers the accommodation chambers and the inner conductors, and an opening for exposing the cover is formed between the outer conductor and the inner conductors. According to this configuration, even if the cover is covered by the outer conductor, an assembled state of the cover with the accommodating member can be confirmed by visually observing the orientation and position of the cover through the opening.

(5) Preferably, the opening is provided to expose the cover in an axial direction of the cores. According to this configuration, the assembled state of the cover can be easily confirmed by visually observing the connector in the axial direction of the cores.

(6) Preferably, the second divided shell is formed with a second crimping portion to be crimped to the outer periphery of the shield member, the cover is formed with a displacement restricting portion disposed in front of the second crimping portion, the second divided shell is formed with a second locking portion disposed to be able to lock the displacement restricting portion, and a locking direction of the second locking portion to the displacement restricting portion is a direction opposite to a crimping direction of the second crimping portion to the shield member. According to this configuration, when the second crimping portion is crimped to the shield member, the second locking portion of the second divided shell locks the displacement restricting portion in the direction opposite to the crimping direction. Thus, the posture inclination of the second divided shell during crimping can be prevented.

Details of Embodiments of Present Disclosure

Embodiment

One specific embodiment of the present disclosure is described with reference to FIGS. 1 to 10. Note that the present invention is not limited to these illustrations and is intended to be represented by claims and include all changes in the scope of claims and in the meaning and scope of equivalents. In this embodiment, an oblique leftward direction in FIGS. 1, 5 to 7 and 10 is defined as a forward direction concerning a front-rear direction. Upper and lower sides shown in FIGS. 1, 2, 4 to 7 and 10 are directly defined as upper and lower sides concerning a vertical direction.

Figure 6:
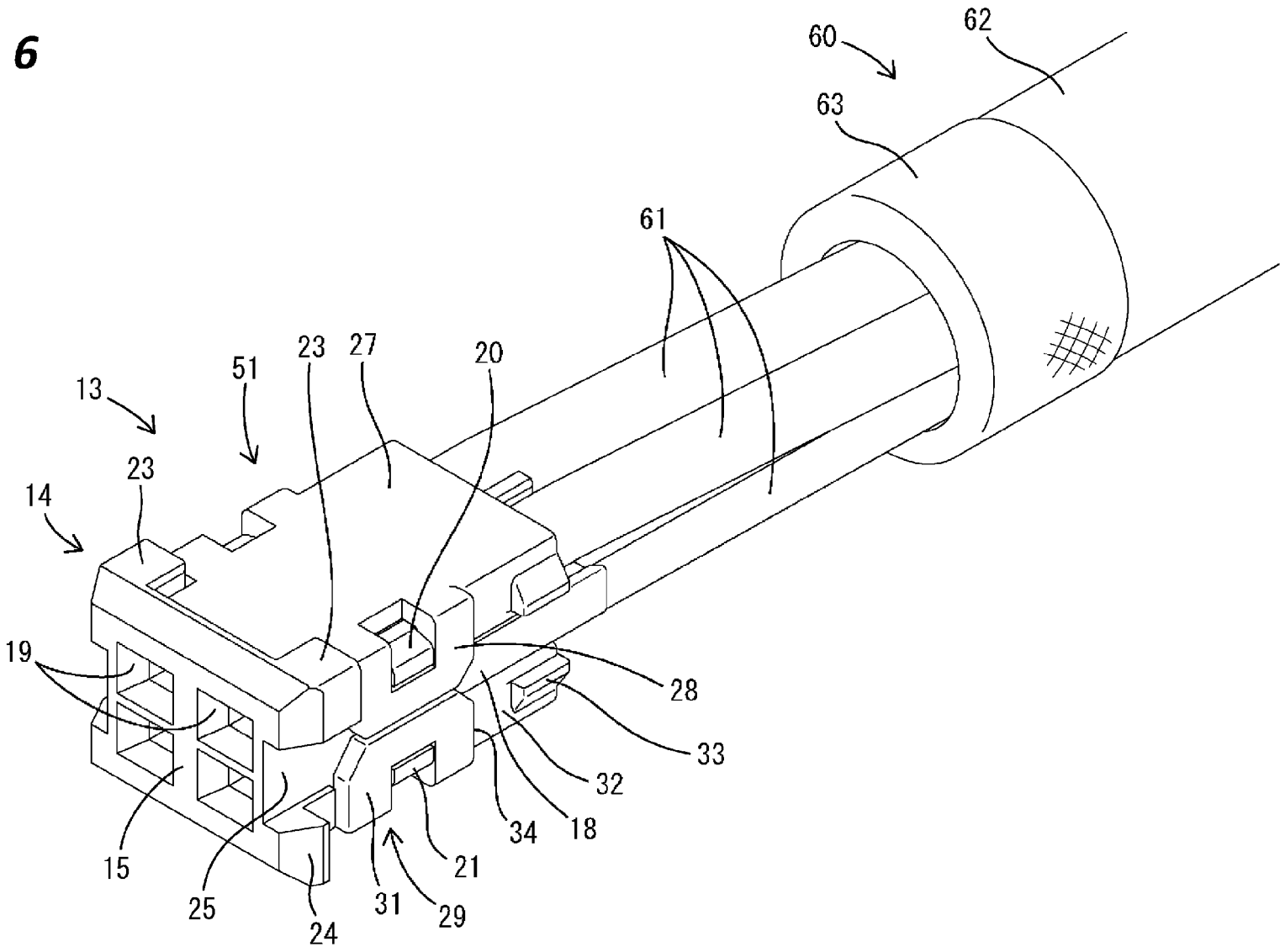
FIG. 6 is a perspective view showing a state where inner conductors are accommodated in a dielectric.
Figure 7:
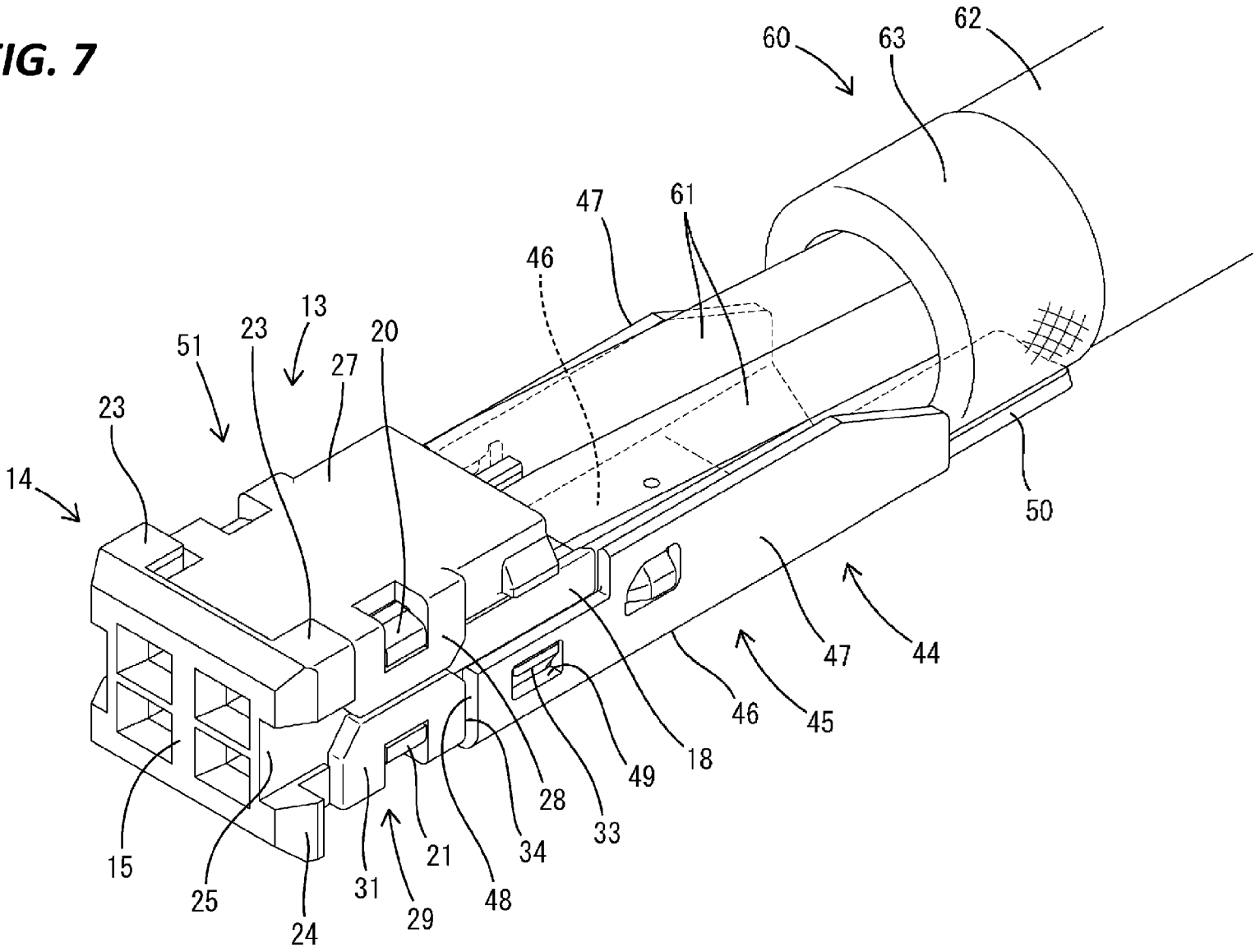
FIG. 7 is a perspective view showing a state where a second divided shell is assembled with the dielectric.

A connector A of this embodiment is connected to a front end part of a shielded cable 60. As shown in FIGS. 6 and 7, the shielded cable 60 is composed of four cores 61 constituted by coated wires, a hollow cylindrical sheath 62 and a tubular shield member 63. The sheath 62 collectively surrounds the four cores 61. The shield member 63 is inserted into the sheath 62 and collectively surrounds the four cores 61. A braided wire or the like is used as the shield member 63.

Figure 5:
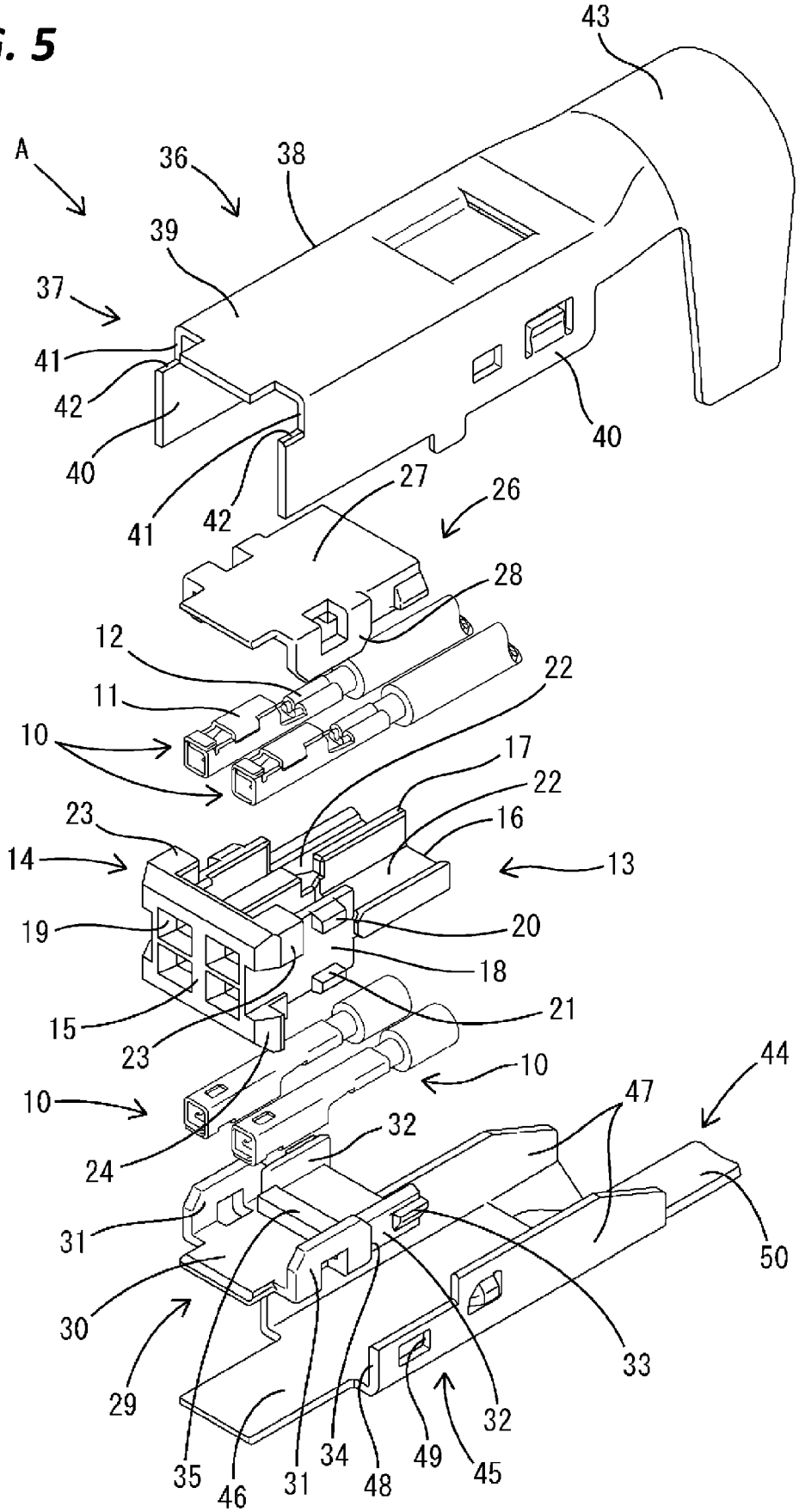
FIG. 5 is an exploded perspective view of the shield terminal.

As shown in FIG. 5, the connector A is configured by assembling four inner conductors 61, one dielectric 13 and one outer conductor 36. The inner conductor 10 has an elongated shape in the front-rear direction. The inner conductor 10 is a single member composed of a rectangular tube portion 11 into which a tab (not shown) of a mating inner conductor is inserted to be brought into contact, and a barrel portion 12 extending rearward from the rear end of the rectangular tube portion 11. A front end part of the core 61 is conductively fixed to the barrel portion 12 by crimping. The crimped core 61 extends rearward from the inner conductor 10. In this embodiment, an extending direction of this core 61 is defined as an axial direction of the core 61.

As shown in FIGS. 6 and 7, the dielectric 13 is configured by assembling an accommodating member 14 made of an insulating material, a first cover 26 (cover as claimed) made of an insulating material and a second cover 29 (cover as claimed) made of an insulating material. The first and second covers 26, 29 have the same shape, but are different in color.

Figure 2:
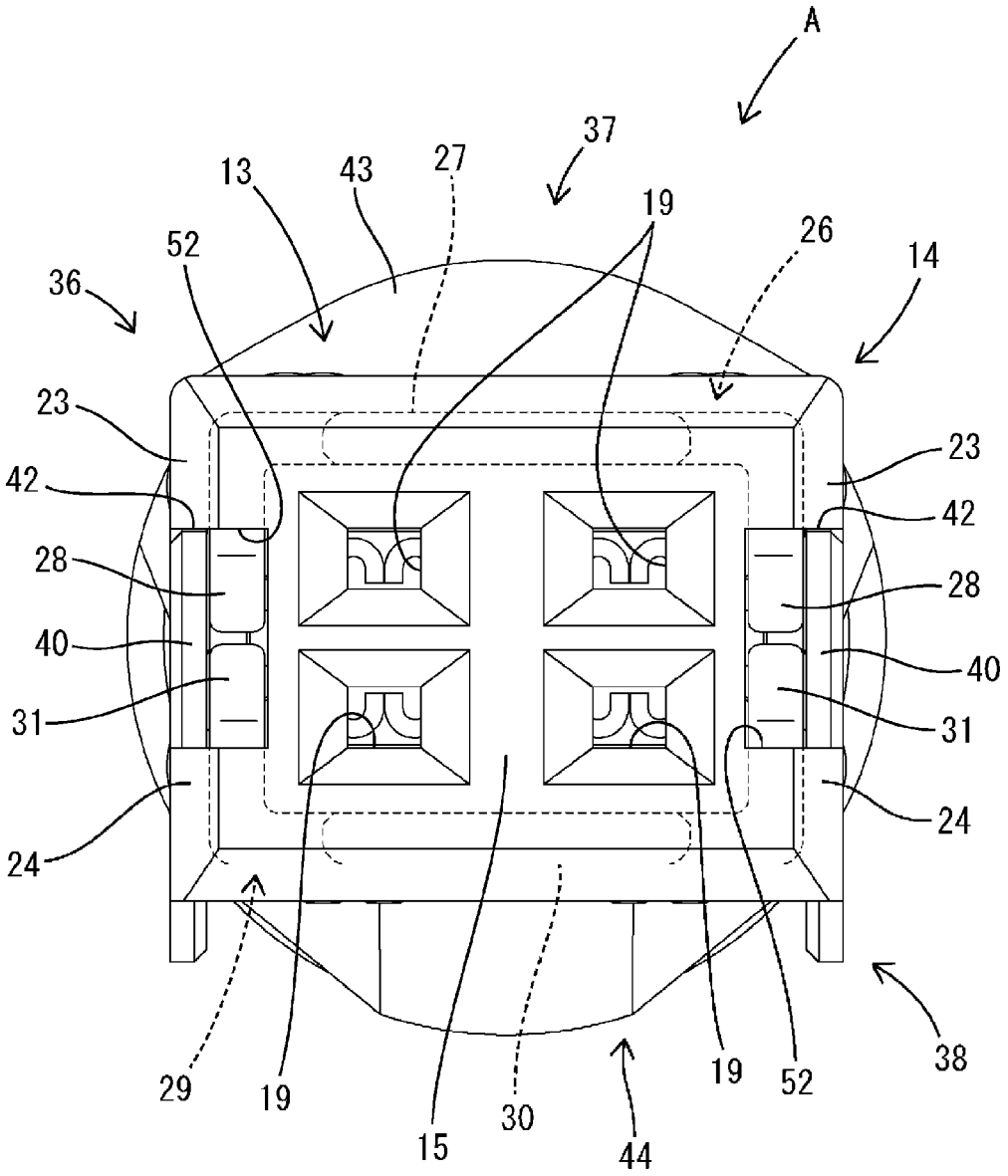
FIG. 2 is a front view of a shield terminal.
Figure 8:
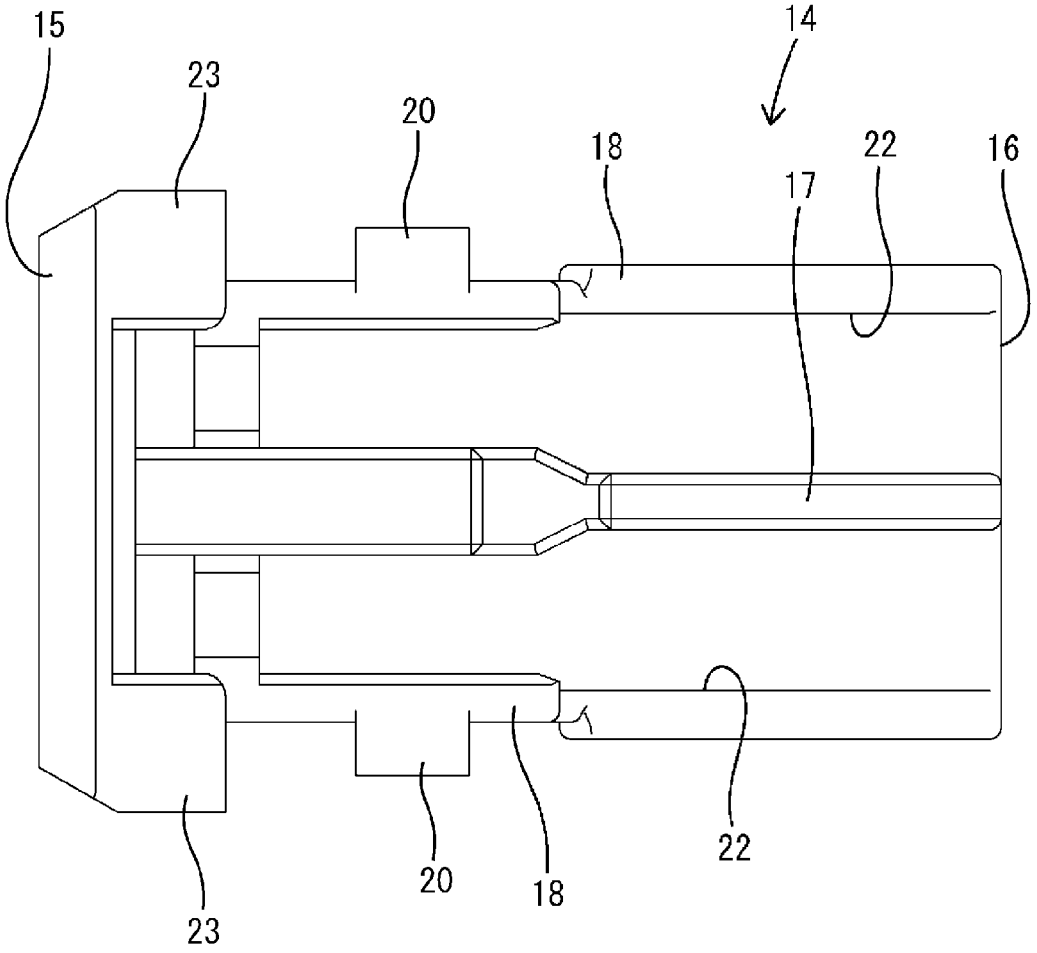
FIG. 8 is a plan view of an accommodating member.
Figure 9:
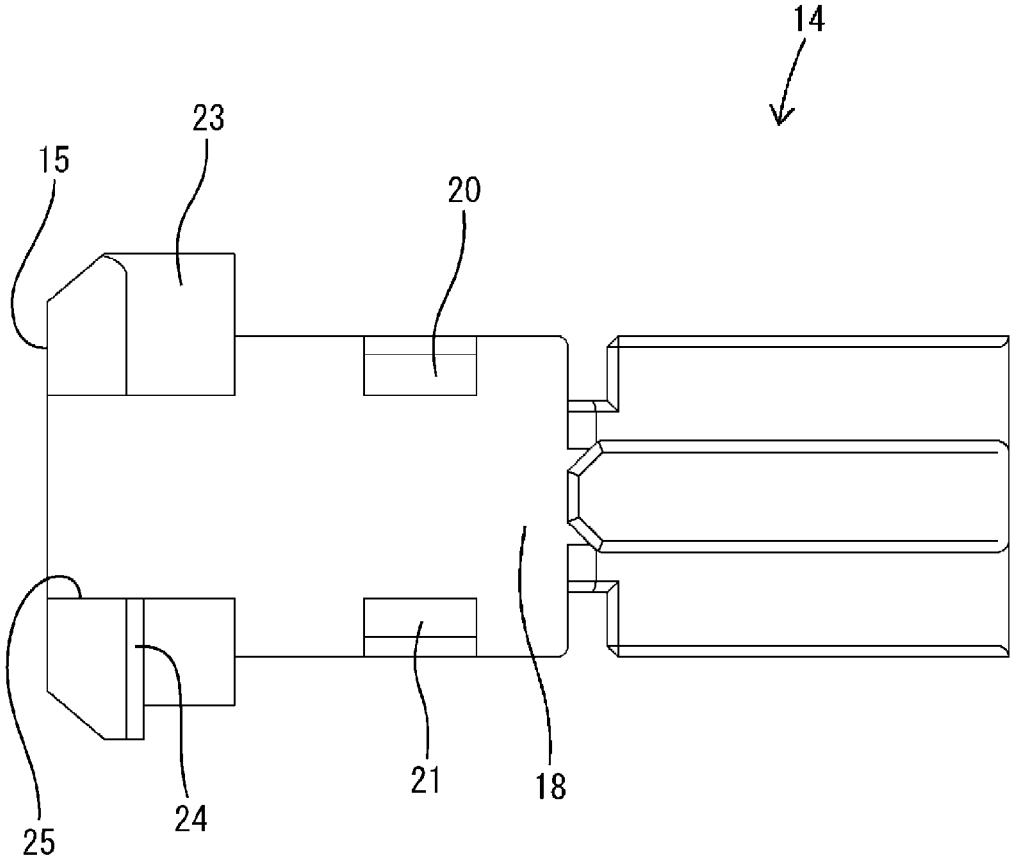
FIG. 9 is a side view of the accommodating member.
Figure 10:
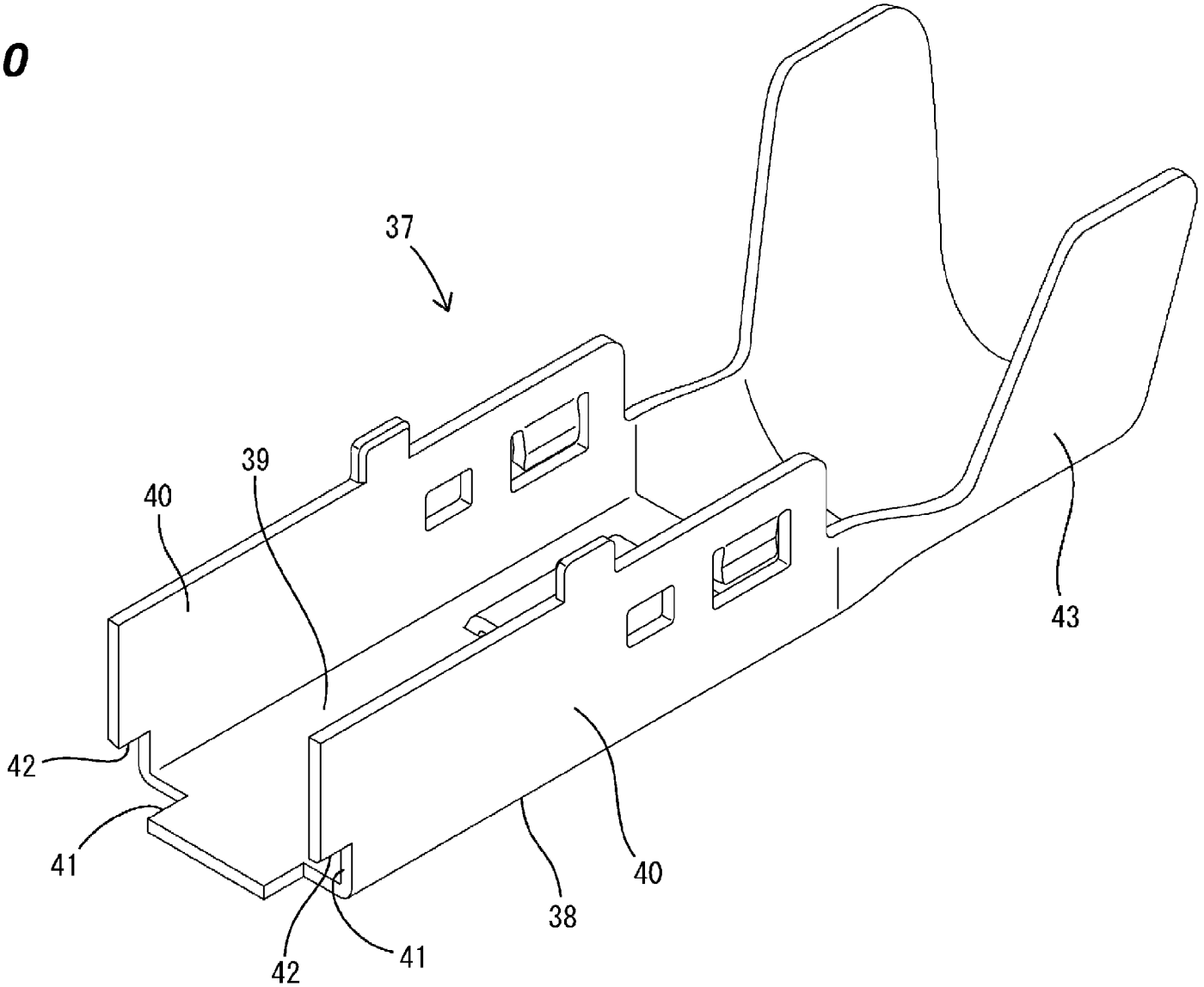
FIG. 10 is a perspective view showing a vertically inverted state of a first divided shell.

As shown in FIGS. 5, 8 and 9, the accommodating member 14 is shaped to be bilaterally symmetric and vertically asymmetric. The accommodating member 14 is a single member composed of a front wall portion 15, a base portion 16, a pair of upper and lower separation wall portions 17 and a pair of left and right side wall portions 18. The front wall portion 15 is in the form of a plate perpendicular to axes of the cores 61. The base portion 16 is in the form of a plate projecting substantially horizontally rearward from the rear surface of the front wall portion 15. As shown in FIGS. 1, 2 and 6, the front wall portion 15 is formed with four penetrating tab insertion holes 19 aligned in the vertical and lateral directions. As shown in FIGS. 5 to 7 and 9, a first lock projection 20 is formed on an upper end part of the outer surface of the side wall portion 18. A second lock projection 21 is formed on a lower end part of the outer surface of the side wall portion 18.

The pair of upper and lower separation wall portions 17 extend in the front-rear direction (in parallel to the axes of the cores 61) and project upward and downward from laterally central parts of the upper and lower surfaces of the base portion 16. The pair of left and right side wall portions 18 extend rearward from both left and right side edges of the front wall portion 15 and extend both upward and downward from both left and right side edges of the base portion 16. The accommodating member 14 is formed with four accommodation chambers 22 vertically and laterally partitioned by the base portion 16, the separation wall portions 17 and the side wall portions 18. Two accommodation chambers 22 on an upper stage side are open upward and rearward of the accommodating member 14 and two accommodation chambers 22 on a lower stage side are open downward and rearward of the accommodating member 14. The entire inner conductor 10 and the front end part of the core 61 connected to that inner conductor 10 are accommodated in each accommodation chamber 22.

As shown in FIGS. 1 and 3 to 9, the front wall portion 15 of the accommodating member 14 is formed with a pair of left and right multi-functional portions 23. The pair of multi-functional portions 23 are formed only on two upper corners, out of four corners of the front wall portion 15. In other words, the pair of multi-functional portions 23 are disposed on both left and right end parts of an upper end part of the rear surface of the front wall portion 15. The pair of multi-functional portions 23 project rearward from the two upper corners of the front wall portion 15 and constitute a vertically asymmetric part of the accommodating member 14 (dielectric 13). Any of a plan view shape, a back view shape and a side view shape of the multi-functional portions 23 is rectangular.

As shown in FIGS. 1, 4, 6 and 7, the front wall portion 15 is formed with a pair of bilaterally symmetrical recesses 25. The pair of recesses 25 are formed by recessing both left and right outer side surfaces of the front wall portion 15. A formation region of the pair of recesses 25 in the vertical direction is a range below the multi-functional portions 23 and above a lower end part of the front wall portion 15. By forming the recesses 25, a pair of bilaterally symmetrical projections 24 are formed on lower end parts of both left and right side surface parts of the front wall portion 15. The pair of projections 24 are formed only on two lower corners, out of the four corners of the front wall portion 15. The pair of projections 24 are formed to project laterally outward from lower end parts of outer side surfaces of the front wall portion 15. The appearance shape of the pair of projections 24 is different from that of the pair of multi-functional portions 23. Thus, the pair of projections 24 constitute the vertically asymmetric part of the accommodating member 14 (dielectric 13) together with the pair of multi-functional portions 23.

The first cover 26 is made of the insulating material and has a bilaterally symmetrical shape. As shown in FIGS. 5 to 7, the first cover 26 is a single component with a substantially horizontal first covering portion 27 and a pair of left and right resilient lock pieces 28 extending downward from both left and right side edges of the first covering portion 27. The first cover 26 is assembled to cover the upper surface of the accommodating member 14 from above. The assembled first cover 26 is locked in a state assembled with the accommodating member 14 by locking the pair of first resilient lock pieces 28 to the first lock projections 20. The first resilient lock pieces 28 are arranged behind and adjacent to the multi-functional portions 23.

With the first cover 26 assembled with the accommodating member 14, the first covering portion 27 covers the two accommodation chambers 22 on the upper stage side. A front end part of the first covering portion 27 is fit between the pair of multi-functional portions 23. The lower surface of the first covering portion 27 is formed with a first retaining portion (not shown) in the form of a projecting rib extending in the lateral direction. With the first cover 26 assembled with the accommodating member 14, the first retaining portion locks rear end parts of the rectangular tube portions 11 of two inner conductors 10 accommodated in the accommodation chambers 22 on the upper stage side from behind. By this locking action, the two inner conductors 10 on the upper stage side are retained and held by the first cover 26.

The second cover 29 is made of the insulating material and shaped to be bilaterally symmetric and vertical symmetric with respect to the first cover 26. As shown in FIG. 5, the second cover 29 is a single component with a substantially horizontal second covering portion 30, a pair of left and right second resilient lock pieces 31, a pair of left and right supporting wall portions 32 and a pair of left and right restricting projections 33 (displacement restricting portion as claimed). The pair of left and right second resilient lock pieces 31 extend upward from both left and right side edges of the second covering portion 30. The pair of left and right supporting wall portions 32 project upward from the both left and right side edges of the second covering portion 30. The pair of left and right restricting projections 33 are formed on the outer surfaces of the both left and right supporting wall portions 32. The second cover 29 is assembled to cover the lower surface of the accommodating member 14 from below. The assembled second cover 29 is locked in a state assembled with the accommodating member 14 by locking the pair of second resilient lock pieces 31 to the second lock projections 21.

The second resilient lock pieces 31 are arranged adjacent to the projections 24 while being spaced rearward of the projections 24. Rear end parts of the second resilient lock pieces 31 extend in the vertical direction (direction perpendicular to the axial direction of the cores 61 and substantially parallel to crimping directions of first and second crimping portions 43, 50 to be described later), and function as restricting edge parts 34.

With the second cover 29 assembled with the accommodating member 14, the second covering portion 30 covers the two accommodation chambers 22 on the lower stage side. A front end part of the second covering portion 30 is fit between the pair of projections 24. As shown in FIG. 5, a second retaining portion 35 in the form of a projecting rib extending in the lateral direction is formed on the upper surface of the second covering portion 30. With the second cover 29 assembled with the accommodating member 14, the second retaining portion 35 locks rear end parts of the rectangular tube portions 11 of two inner conductors 10 accommodated in the accommodation chambers 22 on the lower stage side from behind. By this locking action, the two inner conductors 10 on the lower stage side are retained and held by the second cover 29.

As shown in FIGS. 1, 2, 4 and 5, the outer conductor 36 is formed into a rectangular tube shape as a whole by vertically uniting a first divided shell 37 made of a conductive material and a second divided shell 44 made of a conductive material. A uniting direction of the first and second divided shells 37, 44 is a direction orthogonal to the axial direction of the cores 61.

As shown in FIG. 5, the first divided shell 37 has a half shape having a space open toward a lower surface side. As shown in FIGS. 1, 4, 5 and 10, a front end side region of the first divided shell 37 serves as a first shell 38. A rear end part of the first divided shell 37 serves as the substantially arcuate first crimping portion 43 extending rearward from the rear end of the first shell portion 38. The first shell portion 38 is composed of a substantially horizontal first base plate portion 39 and a pair of left and right first side plate portions 40. The pair of left and right first side plate portions 40 extend downward substantially at a right angle from both left and right side edges of the first base plate portion 39. The first crimping portion 43 extends rearward from the rear end edge of the first base plate portion 39.

As shown in FIGS. 1, 3 to 5 and 10, a front end part of the first shell portion 38 is formed with a pair of bilaterally symmetrical cut portions 41. The pair of cut portions 41 are formed by cutting both left and right end parts of the front end edge of the first base plate portion 39 and upper end parts of the front end edges of the both left and right first side plate portions 40 in a communicating state. A plan view shape of the cut portions 41 is substantially rectangular, similarly to the plan view shape of the multi-functional portions 23. A side view shape of the cut portions 41 is also substantially rectangular, similarly to the side view shape of the multi-functional portions 23. A lower edge part in the cut portion 41 functions as a locking step portion 42 (first locking portion as claimed) facing upward.

Figure 4:
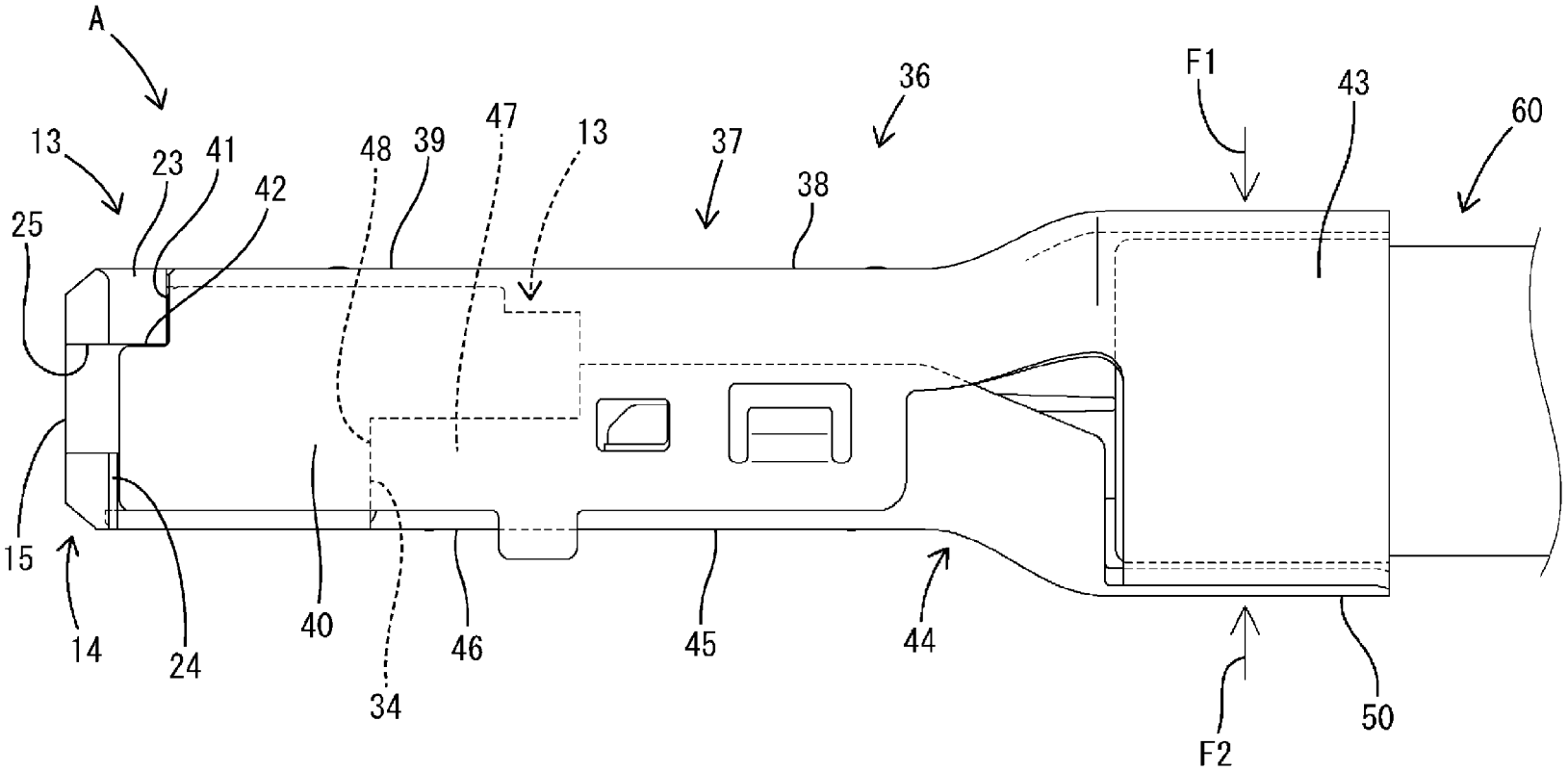
FIG. 4 is a side view of the shield terminal.

As shown in FIGS. 4, 5 and 7, the second divided shell 44 has a half shape having a space open toward an upper surface side. A front end side region of the second divided shell 44 serves as a second shell portion 45. A rear end part of the second divided shell 44 serves as the second crimping portion 50 elongated rearward from the rear end of the second shell portion 45. The second shell portion 45 is composed of a substantially horizontal second base plate portion 46 and a pair of left and right second side plate portions 47 extending upward substantially at a right angle from both left and right side edges of the second base plate portion 46. The second crimping portion 50 extends rearward from the rear end edge of the second base plate portion 46.

The front ends of the pair of second side plate portions 47 are located behind that of the second base plate portion 46. Front end edge parts of the pair of second side plate portions 47 extend in the vertical direction (direction parallel to the restricting edge parts 34 of the second cover 29) and function as locking edge parts 48. Each of the pair of second side plate portions 47 is formed with a locking hole 49 (second locking portion as claimed).

Next, an assembling procedure of the connector A is described. The inner conductors 10 are respectively individually fixed to tip parts of the four cores 61 and the four entire inner conductors 10 and the front end parts of the four cores 61 are respectively accommodated into the accommodation chambers 22. Subsequently, as shown in FIG. 6, the first and second covers 26, 29 are assembled with the accommodating member 14. By this assembling, the dielectric 13 is configured and the four inner conductors 10 are held accommodated in the dielectric 13. The dielectric 13 and the four inner conductors 10 constitute a terminal module 51.

Thereafter, as shown in FIG. 7, the second divided shell 44 is assembled with the terminal module 51. In assembling, the second divided shell 44 is brought closer to the terminal module 51 from above, the pair of second side plate portions 47 are overlapped on the outer surfaces of the pair of supporting wall portions 32 while being resiliently expanded, and the locking holes 49 are fit to the restricting projections 33 to achieve a locked state. By this locking action, the second divided shell 44 is held assembled with the dielectric 13 (second cover 29). The upper surface of the second base plate portion 46 is overlapped on the lower surface of the second covering portion 30. The locking edge parts 48 are in line contact with the restricting edge parts 34 from behind or adjacent to the restricting edge parts 34 while facing from behind with tiny clearances defined therebetween.

Figure 3:
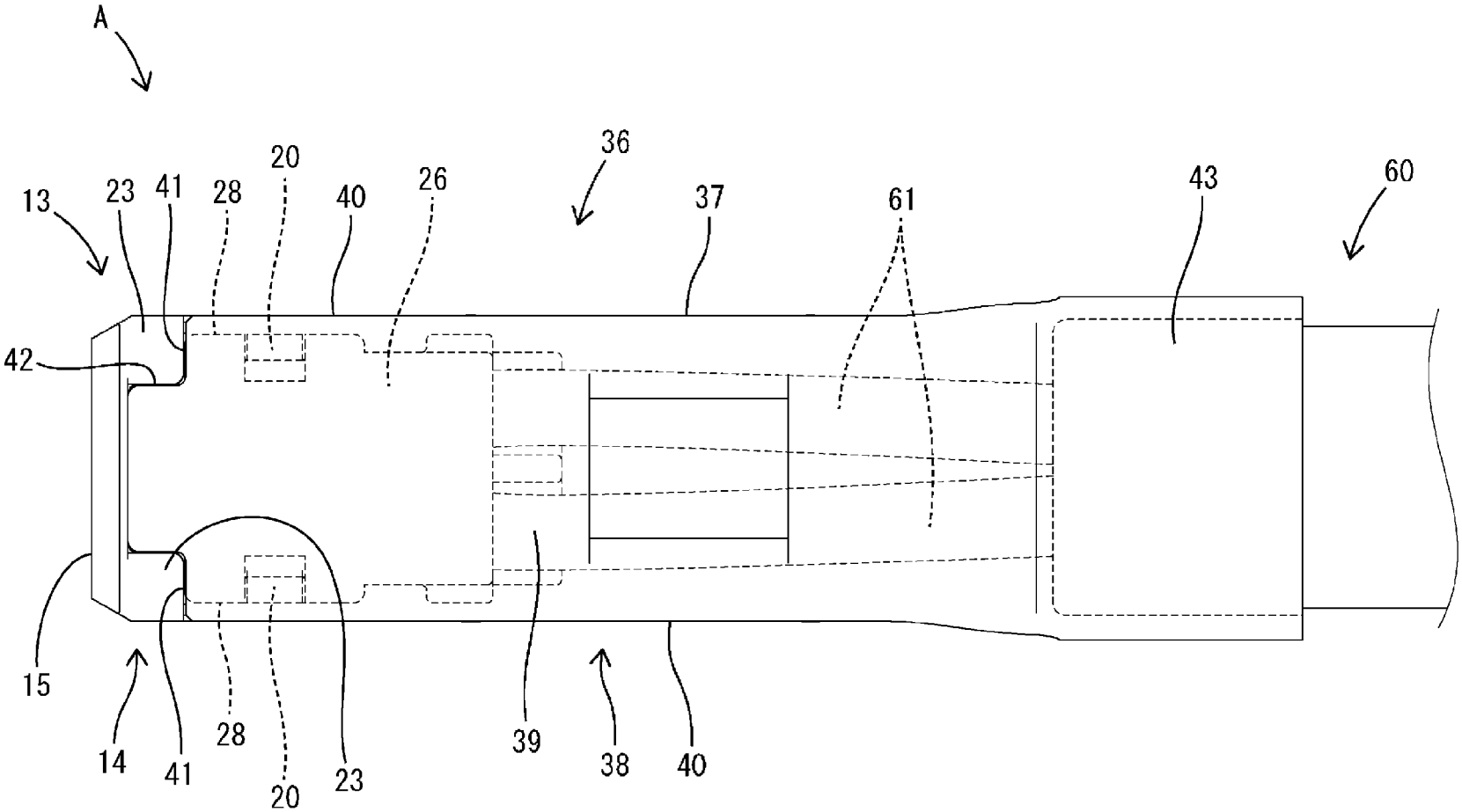
FIG. 3 is a plan view of the shield terminal.

After the second divided shell 44 is assembled, the first divided shell 37 is assembled with the dielectric 13 as shown in FIGS. 1, 3 and 4. In assembling, the first divided shell 37 is brought closer to the dielectric 13 from above, and the first base plate portion 39 is overlapped on the upper surface of the first covering portion 27. Simultaneously with this, the front end parts of the first side plate portions 40 are slipped under the multi-functional portions 23 and the front end part of the first base plate portion 39 is fit between the both left and right multi-functional portions 23. In this way, the pair of multi-functional portions 23 are fit into the pair of cut portions 41 and exposed on the outer surface (upper surface and side surfaces) of the first divided shell 37 (outer conductor 36). The pair of first side plate portions 40 are overlapped on the outer surfaces of the pair of second side plate portions 47.

The first crimping portion 43 is located to correspond to the second crimping portion 50 in the front-rear direction (axial direction of the cores 61). After the first and second divided shells 37, 44 are assembled with the dielectric 13, the first and second crimping portions 43, 50 are crimped to the outer periphery of the shield member 63 of the shielded cable 60. In a crimping process, as shown in FIG. 4, an upward pressing force F2 is applied to the second crimping portion 50 at the same time as a downward pressing force F1 is applied to the first crimping portion 43.

Directions of the pressing forces F1, F2 during crimping are directions orthogonal to the axial direction of the cores 61. Particularly, the direction of the pressing force F1 pressing the first crimping portion 43 is a direction substantially parallel to an assembling direction of the first divided shell 37 with the dielectric 13. Since the first crimping portion 43 is disposed in the rear end part of the first divided shell 37, if the downward pressing force F1 is applied to the first crimping portion 43, the posture of the first divided shell 37 is going to be inclined to displace the front end part of the first divided shell 37 upward. A displacing direction of the front end part of the first divided shell 37 at this time is vertically opposite to an applying direction of the pressing force F1 to the first crimping portion 43, i.e. a direction to move the first divided shell 37 away from the dielectric 13. However, since the locking step portions 42 formed in the front end part of the first divided shell 37 come into contact with the multi-functional portions 23 of the dielectric 13 from below, the posture inclination of the first divided shell 37 is restricted.

Further, the direction of the second pressing force F2 pressing the second crimping portion 50 is a direction substantially parallel to an assembling direction of the second divided shell 44 with the dielectric 13. Since the second crimping portion 50 is disposed in the rear end part of the second divided shell 44, if the upward pressing force F2 is applied to the second crimping portion 50, the posture of the second divided shell 44 is going to be inclined to displace the front end part of the second divided shell 44 downward. A displacing direction of the front end part of the second divided shell 44 at this time is vertically opposite to an applying direction of the pressing force F2 to the second crimping portion 50, i.e. a direction to move the second divided shell 44 away from the dielectric 13.

However, since the locking holes 49 formed forward of the second crimping portion 50 in the second divided shell 44 are fit to the restricting projections 33, the posture inclination of the second divided shell 44 is restricted.

Further, if the posture of the second divided shell 44 starts to be inclined, the locking edge parts 48 of the second divided shell 44 are displaced to be inclined forward in a side view and interfere with the restricting edge parts 34 of the dielectric 13. Thus, the posture inclination of the second divided shell 44 is also restricted by this interference.

If the first and second divided shells 37, 44 are assembled with the terminal module 51 and the first and second crimping portions 43, 50 are crimped to the shield member 63, the first and second divided shells 37, 44 are united to constitute the outer conductor 36 and the assembling of the connector A is completed. In a front end part of the connector A, the multi-functional portions 23 of the dielectric 13 are exposed on the upper surface and side surface upper end parts of the outer conductor 36. The projections 24 are exposed on the lower surface and side surface lower end parts of the outer conductor 36.

Since exposed areas of the projections 24 on the outer surface of the outer conductor 36 are smaller than those of the multi-functional portions 23 on the outer surface of the outer conductor 36, it is difficult to visually observe the projections 24. In contrast, it is easy to visually observe the multi-functional portions 23 having a larger exposed area on the outer surface of the outer conductor 36. In this way, vertical and lateral orientations of the connector A can be easily confirmed by visual observation, using the multi-functional portions 23 as indices. Thus, in inserting the connector A into a housing (not shown), it can be avoided that the connector A is inserted in an improper posture with respect to the vertical and/or lateral direction(s).

Further, as shown in FIGS. 1 and 2, openings 52 are formed between the first side plate portions 40 of the first divided shell 37 (outer conductor 36) and the recesses 25 in the side surfaces of the dielectric 13 (accommodating member 14) in the front end surface (front surface) of the connector A. Lower end parts of the first resilient lock pieces 28 and upper end parts of the second resilient lock pieces 31 surrounded by the outer conductor 36 can be visually observed through the openings 52 from the front of the connector A. Since the first and second covers 26, 29 are different in color, it can be confirmed whether or not the first and second covers 26, 29 are properly assembled with the accommodating member 14 by looking into the inside of the outer conductor 36 through the openings 52 after confirming the vertical orientation of the connector A by the positions of the multi-functional portions 23.

The connector A of this embodiment includes the plurality of inner conductors 10, the dielectric 13 and the outer conductor 36. The plurality of inner conductors 10 are individually connected to the front end parts of the plurality of cores 61 constituting the shielded cable 60. The dielectric 13 accommodates the plurality of inner conductors 10. Since the multi-functional portions 23 and the projections 24 different in shape are formed on an outer peripheral surface part of the dielectric 13, the outer surface shape of the dielectric 13 is asymmetric with respect to the axes (not shown) of the cores 61 parallel to the front-rear direction. The outer conductor 36 is configured by uniting the first divided shell 37 having a half shape and the second divided shell 44 having a half shape into a tubular shape, and surrounds the inner conductors 10 and the dielectric 13.

The first crimping portion 43 to be crimped to the outer periphery of the shield member 63 constituting the shielded cable 60 is formed in the rear end part of the first divided shell 37. The multi-functional portions 23 are formed in a part of the outer surface of the dielectric 13 constituting an asymmetric shape (front end part of the dielectric 13). The multi-functional portions 23 are exposed on the outer surface of the outer conductor 36 and in the form of projections forward of the first crimping portion 43 on the outer surface of the dielectric 13. The first divided shell 37 is formed with the locking step portions 42 disposed to be able to lock the multi-functional portions 23. A locking direction of the locking step portions 42 to the multi-functional portions 23 is a direction opposite to the crimping direction of the first crimping portion 43 to the shield member 63. Thus, when the pressing force F1 acts on the first divided shell 37 in the crimping direction (downward direction), the locking step portions 42 of the first divided shell 37 lock the multi-functional portions 23 in a direction (upward direction) opposite to the pressing force F1.

The multi-functional portions 23 constituting the asymmetric part of the dielectric 13 are in the form of projections and exposed on the outer surface of the outer conductor 36. Thus, the vertical orientation of the connector A can be confirmed by visually observing the positions of the multi-functional portions 23. When the pressing force F1 acts on the first crimping portion 43 in the crimping direction and the first crimping portion 43 is crimped to the shield member, the locking step portions 42 of the first divided shell 37 lock the multi-functional portions 23 in the direction opposite to the pressing force F1 (crimping direction of the first crimping portion 43 to the shield member 63). Thus, the posture inclination and improper deformation of the first divided shell 37 during crimping can be prevented.

Further, the multi-functional portions 23 are disposed in the front end part of the dielectric 13. In inserting the connector A into the housing (not shown), the orientation of the connector A is confirmed by visually observing the front end part of the connector A laterally or from above. Since the multi-functional portions 23 are exposed on the outer surface of the outer conductor 36 in the front end part of the dielectric 13, visual observation is easier as compared to the case where the multi-functional portions 23 are exposed behind the front end of the connector A. Further, since the multi-functional portions 23 are formed only on two corners, out of the four corners of the front wall portion 15 of the dielectric 13, the orientation of the connector A can be visually confirmed from many directions by the presence of the two multi-functional portions 23. Further, since a long distance in the front-rear direction is ensured between the first crimping portion 43 and the multi-functional portions 23 by disposing the multi-functional portions 23 in the front end part of the dielectric 13, a function of preventing the posture inclination of the first divided shell 37 is excellent.

Further, the dielectric 13 includes the accommodating member 14 and the first cover 26. The accommodating member 14 includes the accommodation chambers 22 for accommodating the inner conductors 10. The first cover 26 is assembled with the accommodating member 14 to cover the accommodation chambers 22 and the inner conductors 10. The multi-functional portions 23 are formed to locally project laterally from the outer surface of the accommodating member 14 (outer side surfaces of the front wall portion 15). By this form of the multi-functional portions 23, the openings 52 enabling the visual observation of the first and second covers 26, 29 are formed between the outer surface of the accommodating member 14 (outer side surfaces of the front wall portion 15) and the inner surface(s) of the outer conductor 36 (first side plate portions 40).

In other words, the openings 52 are formed between the outer conductor 36 and the inner conductors 10. The openings 52 are provided to expose the first and second covers 26, 29 in a direction (forward direction) parallel to the axial direction of the cores 61 in the front surface of the dielectric 13. That is, the openings 52 expose the first and second covers 26, 29 to the outside of the outer conductor 36. According to this configuration, even if the outer peripheral surfaces of the first and second covers 26, 29 are covered by the outer conductor 36, the orientations and positions of the first and second covers 26, 29 can be visually observed in the openings 52 open in the front surface of the dielectric 13. In this way, an assembled state of the first and second covers 26, 29 with the accommodating member 14 can be easily confirmed from the front surface side (front side) of the connector A.

Further, the second divided shell 44 is formed with the second crimping portion 50 to be crimped to the outer periphery of the shield member 63. The second cover 29 is formed with the restricting projections 33 and the restricting edge parts 34 disposed in front of the second crimping portion 50. The second divided shell 44 is formed with the locking edge parts 48 disposed to be able to lock the restricting projections 33 and the locking holes 49 disposed to be able to lock the restricting edge parts 34. A locking direction of the locking holes 49 to the restricting projections 33 is a direction opposite to the crimping direction of the second crimping portion 50 to the shield member 63. When the pressing force F2 acts on the second crimping portion 50 in the crimping direction and the second crimping portion 50 is crimped to the shield member 63, the locking holes 49 of the second divided shell 44 lock the restricting projections 33 in the direction opposite to the pressing force F2 (crimping direction of the second crimping portion 50 to the shield member 63). In this way, the posture inclination of the second divided shell 44 during crimping can be prevented.

Other Embodiments

The present invention is not limited to the above described and illustrated embodiment and is represented by claims. The present invention includes all changes in the meaning of equivalents to the scope of claims and in the scope of claims and is intended to also include the following embodiments.

Although the multi-functional portions are formed in the front end part of the dielectric in the above embodiment, multi-functional portions may be formed at positions behind the front end part of the dielectric.

Although the openings enabling the visual observation of the first and second covers are formed between the accommodating member (inner conductors) and the outer conductor in the above embodiment, such openings may not be formed.

Although the openings enabling the visual observation of the first and second covers are open in the front surface of the connector in the above embodiment, an opening enabling the visual observation of the first and second covers may be open in a side surface (any one of upper, lower, left and right surfaces) of the connector.

Although the four inner conductors are accommodated in the dielectric in the above embodiment, the number of the inner conductors to be accommodated into one dielectric may be three or less or five or more.

Although the dielectric is configured by uniting a plurality of components (accommodating member, first cover and second cover) in the above embodiment, a dielectric may be composed only of one component.

Although the pair of covers (first and second covers) have the same shape in the above embodiment, a pair of covers (first and second covers) may have mutually different shapes.

Although the dielectric includes the pair of covers (first and second covers) in the above embodiment, a dielectric may be composed of only one cover or three or more covers.

List of Reference Numerals

10 inner conductor
11 rectangular tube portion
12 barrel portion
13 dielectric
14 accommodating member
15 front wall portion
16 base portion
17 separation wall portion
18 side wall portion
19 tab insertion hole
20 first lock projection
21 second lock projection
22 accommodation chamber
23 multi-functional portion
24 projection
25 recess
26 first cover (cover)
27 first covering portion
28 first resilient lock piece
29 second cover (cover)
30 second covering portion
31 second resilient lock piece
32 supporting wall portion
33 restricting projection (displacement restricting portion)
34 restricting edge part
35 second retaining portion
36 outer conductor
37 first divided shell
38 first shell portion
39 first base plate portion
40 first side plate portion
41 cut portion
42 locking step portion (first locking portion)
43 first crimping portion
44 second divided shell
45 second shell portion
46 second base plate portion
47 second side plate portion
48 locking edge part
49 locking hole (second locking portion)
50 second crimping portion
51 terminal module
52 opening
60 shielded cable
61 core
62 sheath
63 shield member
A connector
F1 pressing force
F2 pressing force

What is claimed is:

1. A connector, comprising:
a plurality of inner conductors;
a dielectric;
an outer conductor; and
a multi-functional portion,
wherein:

the plurality of inner conductors are individually connected to front end parts of a plurality of cores constituting a shielded cable, the dielectric accommodates the plurality of inner conductors, the outer conductor is configured by uniting a first divided shell and a second divided shell, the outer conductor surrounds the inner conductors and the dielectric, a first crimping portion to be crimped to an outer periphery of a shield member constituting the shielded cable is formed in a rear end part of the first divided shell, the multi-functional portion is exposed on an outer surface of the outer conductor and in the form of a projection forward of the first crimping portion on an outer surface of the dielectric, the first divided shell is formed with a first locking portion disposed to be able to lock the multi-functional portion, a locking direction of the first locking portion to the multi-functional portion is a direction opposite to a crimping direction of the first crimping portion to the shield member, the first divided shell includes a base plate portion and a pair of left and right side plate portions extending downward from both left and right end edges of the base plate portion, the first divided shell is formed with a pair of cut portions formed by cutting both left and right end parts of the base plate portion and upper end parts of the pair of left and right side plate portions in a communicating state, and the multi-functional portions are paired and exposed to an upper surface and both left and right side surfaces of the first divided shell through the pair of cut portions.

2. The connector of claim 1, wherein the multi-functional portion is disposed in a front end part of the dielectric.

3. The connector of claim 2, wherein the multi-functional portions are formed only on two corners, out of four corners of a front wall portion of the dielectric.

4. The connector of claim 1, wherein:

the dielectric includes an accommodating member and a cover, the accommodating member includes accommodation chambers for accommodating the inner conductors, the cover covers the accommodation chambers and the inner conductors, and an opening for exposing the cover is formed between the outer conductor and the inner conductors.

5. The connector of claim 4, wherein the opening is provided to expose the cover in an axial direction of the cores.

6. The connector of claim 4, wherein:

the second divided shell is formed with a second crimping portion to be crimped to the outer periphery of the shield member, the cover is formed with a displacement restricting portion disposed in front of the second crimping portion, the second divided shell is formed with a second locking portion disposed to be able to lock the displacement restricting portion, and a locking direction of the second locking portion to the displacement restricting portion is a direction opposite to a crimping direction of the second crimping portion to the shield member.

* * * * *